US005590208A

United States Patent [19]

Koyano et al.

[11] Patent Number: 5,590,208

[45] Date of Patent: Dec. 31, 1996

[54] SPEAKER SYSTEM

[75] Inventors: Shinji Koyano; Koushirou Kogure; Takashi Ohyaba; Makoto Sakakibara; Katsutoki Hanayama, all of Saitama-ken, Japan

[73] Assignee: Pioneer Electronic Corporation, Tokyo, Japan

[21] Appl. No.: 419,902

[22] Filed: Apr. 11, 1995

[30] Foreign Application Priority Data

Apr. 18, 1994 [JP] Japan ..... 6-079057

[51] Int. Cl.[6] ..... H04R 25/00

[52] U.S. Cl. ..... 381/154; 381/159; 181/156

[58] Field of Search ..... 381/158, 159, 381/160, 154, 188, 205; 181/155, 156, 199

[56] References Cited

U.S. PATENT DOCUMENTS 5,197,103 3/1993 Hayakawa ..... 381/159
5,414,230 5/1995 Nienwendijk et al. ..... 381/71

FOREIGN PATENT DOCUMENTS 4-301998 10/1992 Japan ..... 381/159

*Primary Examiner*—Sinh Tran

*Attorney, Agent, or Firm*—Nikaido, Marmelstein, Murray & Oram LLP

[57] ABSTRACT

A duct is provided in a cabinet for radiating sound pressure emitted from a speaker unit. The duct comprises a first duct and a second duct. The first duct extends in a direction perpendicular to a radiating direction of the sound pressure radiated from a front side of the speaker unit. The second duct is connected to an end of the first duct. An inner end of of the second duct is communicated with the cabinet. The speaker unit is disposed at a connection of the first and second ducts.

6 Claims, 12 Drawing Sheets

SPEAKER SYSTEM

BACKGROUND OF THE INVENTION

The present invention relates to a speaker system having a bass-reflex cabinet.

In the speaker system, the formation of the cabinet affects the reproduction of low frequency sound. A bass-reflex cabinet is provided with a port formed in a front panel of a closed box. The sound rearwardly radiated in the cabinet is discharged from the port for increasing the low frequency characteristic.

FIG. 11 shows a conventional bass-reflex cabinet. A cabinet 1 comprises a speaker unit 2 secured to a front panel 1A of the cabinet 1. A bass-reflex duct 3 having a port 3*a* is provided on the front panel 1A at a lower portion of the speaker unit.

When the speaker unit 2 emits sound, a part of the sound is radiated in the rearward direction in a cavity la of the cabinet 1 and enters the duct 3. The sound is emitted from the port 3*a* and corrected into the same phase as the sound forwardly radiated from the speaker unit 2. Thus, the low sound characteristic is increased.

The cavity 1*a* of the cabinet 1 has compliance C0 and the duct 3 has mass m0.

A dividing network comprising a combination of a low-pass filter and a high-pass filter is used for deriving a frequency band corresponding to a particular speaker system. The dividing network is provided between an amplifier and the speaker system so as to divide an audio-frequency output of the amplifier into high, middle and low bands of frequencies. In order to increase the low frequency characteristic, the middle and high frequency bands are cut to extract the low frequency range which is applied to the bass-reflex cabinet.

However, the dividing network affects characteristics of sound pressure frequency, phase and impedance.

FIG. 12 shows a mechanical equivalent circuit of the speaker system. Mechanical impedance Zm of the speaker system is connected to the compliance C0 of the cavity 1*a* and the mass m0 of the duct 3 in series, respectively. The compliance C0 and the mass m0 are connected in parallel with each other.

When a driving force F is produced in accordance with an input signal from an amplifier thorough a dividing network, a diaphragm of the speaker unit 2 is vibrated to emit sound of volume velocity U0. The volume velocity U0 is divided into volume velocity U1 and volume velocity U2 in dependency on the values of the compliance CO and the mass m0, respectively. The volume velocities U0 and the U2 are combined to the volume velocity U1.

FIG. 13 shows characteristics of sound pressures (SPL) which are obtained by converting the volume velocities U0, U2 and U which is a combination of U0 and U2. In the speaker unit, the dividing network is not provided.

FIG. 14 shows the combined sound pressure U when the dividing network is used. The dividing network operates to cut the high frequency range of the sound pressure U in accordance with a high-cut characteristic. Furthermore, the sound pressure is humped as shown by a dotted line at a frequency fp which is slightly higher than the lowest resonance frequency fo.

FIG. 15 shows the combined sound pressure U and an impedance characteristic Z. The dotted lines show the sound pressure and impedance characteristics without the dividing network.

FIG. 16 shows an equivalent circuit for explaining why the sound pressure is humped when the dividing network is used. Inductance L of low-pass filter in the dividing network is connected to a capacitive component Ce in series to compose a series resonance circuit. Since the impedance is reduced at the frequency fp, flow of the current is increased.

Accordingly, in the speaker system with the dividing network, the sound pressure is humped at the frequency fp so that the sound pressure of the low frequency range is masked, thereby producing an oppressive sound in low frequency range.

In order to eliminate the disadvantage, a correction circuit is provided between the dividing network and the speaker system to correct the hump of the sound pressure. However, since the correction circuit is costly, manufacturing cost of the speaker system is increased.

FIG. 17 shows a bass-reflex cabinet of another conventional speaker system without using the dividing network. In the system, the high frequency range is cut in accordance with compliance in a cavity of the cabinet in front of the speaker unit.

A bass-reflex cabinet 4 has a central partition 5 to divide the cabinet 4 into a front cavity 5*a* and a rear cavity 5*b*. The speaker unit 2 is secured to the partition 5 facing on the front cavity 5*a*. The front cavity 5*a* has compliance C1, and a duct 6 having a mass m3 is provided on a front panel 4*a* of the cabinet 4. The rear cavity 5*b* has the compliance C0, and a duct 7 having the mass m0 is provided on a rear panel 4*b* opposite to the duct 6.

FIG. 18 shows an equivalent circuit and FIG. 19 shows a sound pressure characteristic SPL and an impedance characteristic Z of the system of FIG. 17.

FIG. 20 shows a modification of the speaker system of FIG. 17. The speaker unit 2 is secured to an upper portion of the partition 5 and a duct 7' is provided on the partition 5 at a lower portion of the speaker unit 2 for communicating the rear cavity 5*b* with the front cavity 5*a*. The rear panel 4*b* has no duct. Other structures are the same as those of FIG. 17 and the same parts thereof are identified with the same reference numerals as FIG. 17.

FIG. 21 shows an equivalent circuit and FIG. 22 shows a sound pressure characteristic SPL and an impedance characteristic Z.

In these speaker system, the compliance C0 determined by the volume of the rear cavity 5*b* and the mass m0 of the duct 7 affect the low frequency characteristic. If the values of compliance C0 and mass m0 are increased, the low frequency characteristic is increased.

The compliance C1 determined by the volume of the front cavity 5*a* and the mass m1 of the duct 6 cause an unnecessary high frequency range to attenuate. In order to increase the low frequency characteristic, it is necessary to increase the compliance C0 and C1, causing the sizes (volumes) of the cavities 5*a* and 5*b* to be increased.

As shown in FIGS. 19 and 22, each of the sound pressures has a double humped characteristic. Thus, it is possible to obtain a flat top characteristic at a necessary frequency range.

SUMMARY OF THE INVENTION

An object of the present invention is to provide a speaker system where a low frequency characteristic is increased with a simple structure at a low cost.

According to the present invention, there is provided a speaker system having a cabinet, a speaker unit and a duct for radiating sound pressure emitted from the speaker unit, comprising the duct comprising a first duct extending in a direction perpendicular to a radiating direction of the sound pressure radiated from a front side of the speaker unit, and a second duct connected to an end of the first duct at one of ends thereof, and the other end of the second duct being communicated with in a space of the cabinet, the speaker unit being disposed at a connection of the first and second ducts.

The sound pressure radiated from a rear side of the speaker unit is propagated in the first duct and applied to the sound pressure from the front side of the speaker unit, and combined sound pressure is discharged from the first duct.

The other objects and features of this invention will become understood from the following description with reference to the accompanying drawings.

DETAILED DESCRIPTION OF THE PREFERRED EMBODIMENTS

Figure 1A:
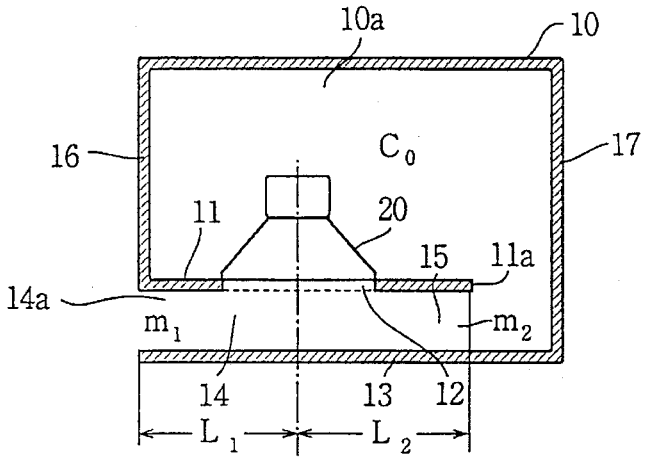
FIG. 1*a* is a sectional side view showing a cabinet of a speaker system according to the present invention.
Figure 1B:
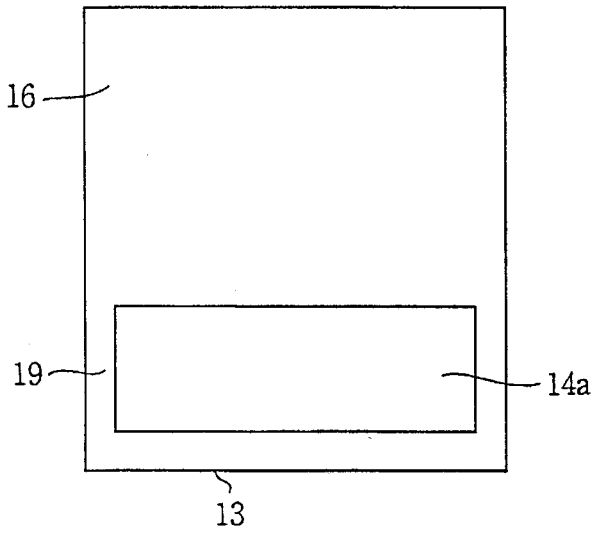
FIG. 1*b* is a front view of the cabinet of FIG. 1*a*.

Referring to FIG. 1 showing a bass-reflex cabinet 10 of a speaker system according to the present invention, a front panel 16 of the cabinet 10 has a length which is shorter than a rear panel 17. An inner base plate 11 is secured to the front panel 16 and opposite side plates 19, and disposed in the cabinet to be parallel with a bottom panel 13 at a predetermined distance therebetween. An innermost end portion 11a of the inner base plate 11 is disposed in the cabinet at a predetermined distance from the rear panel 17. Thus, a horizontal duct is formed in the horizontal direction between the inner base 11 and the bottom panel 13.

A speaker unit 20 is secured to a peripheral wall of an opening 12 formed in the inner base plate 11. At the rear of the speaker unit 20, a cavity 10*a* having the compliance C0 is formed in the cabinet 10. The horizontal duct is divided into a first duct 14 formed between the central axis of the speaker unit 20 and a port 14*a* of the duct, and a second duct 15 formed between the central axis of the speaker unit 20 and the innermost end portion 11*a* of the inner plate 11. The second duct 15 is communicated with the cavity 10*a*. The first duct 14 has a mass m1 and the second duct 15 has a mass m2.

When the speaker unit 20 emits sound, a part of the sound is radiated in the cavity 10*a* and enters the second duct 15 and added to the sound from the front of the speaker unit 20. The confluent sound is discharged from the port 14*a* passing through the sound in the first duct 14.

A sectional area of the first duct 14 is smaller than an area of a diaphragm (not shown) of the speaker unit 20.

Figure 2:
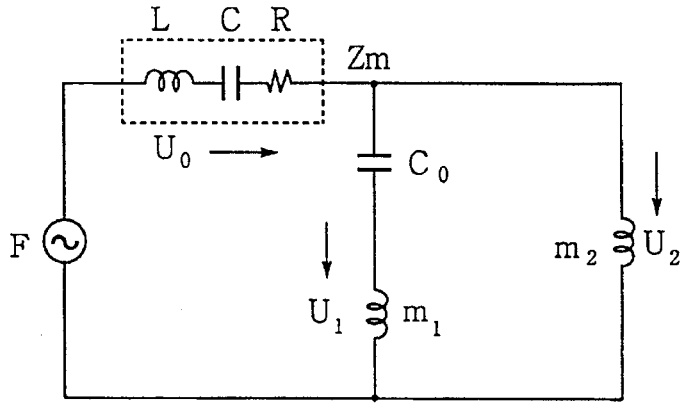
FIG. 2 is an equivalent circuit showing a mechanical system of the speaker system.

FIG. 2 shows a mechanical equivalent circuit of the speaker system. The circuit comprises a mechanical impedance Zm having L, C and R, and connected to the compliance C0 of the cavity 10*a* and to the mass m2 of the second duct 15, respectively in series. The compliance C0 is connected to the mass m1 of the first duct 14 in series, and the compliance C0 and the mass m1 are connected in parallel with the mass m2.

In operation, when the driving force F is applied, the volume velocity U0 is produced in accordance with the vibration of the diaphragm of the speaker unit 20. The volume velocity U0 is divided into the volume velocity U1 of the first duct 14 and the volume velocity U2 of the second duct 15 in dependency on the values of the compliance C0 of the cavity 10*a* and the mass m1 of the first duct 14, and the mass m2 of the second duct 15, respectively. The volume velocities U0 and U2 are combined to the volume velocity U1.

Figure 3:
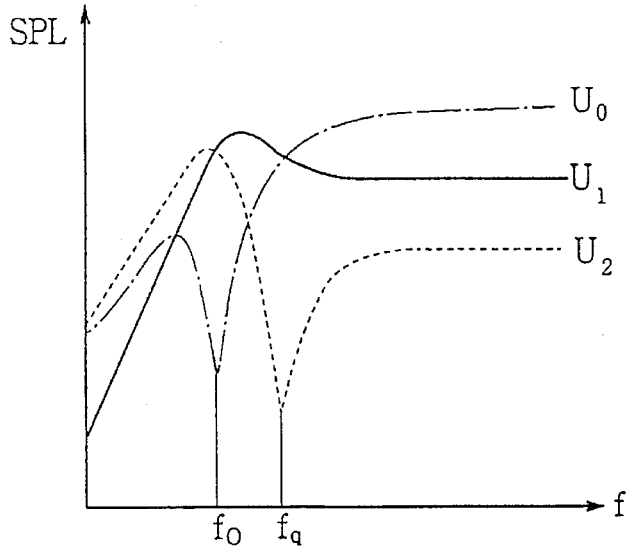
FIG. 3 is a graph showing sound pressure characteristics of the speaker system without a dividing network.

Referring to FIG. 3, the volume velocities U0, U1 and U2 are converted into characteristics of sound pressures without the dividing network. Since the sound pressure U0 is produced in the forward direction and the sound pressure U2 is produced in the rearward direction corresponding to the diaphragm of the speaker unit 20, the sound pressures U0 and U2 have a reverse phase. Thus, the sound pressure U1 is obtained by combining the sound pressures U0 and U2, namely by subtracting the sound pressure U2 from the sound pressure U0.

The combined sound pressure U2 is humped at the frequency fo and reduced in a higher frequency range than the frequency fo. Such a sound characteristic is caused by the sound pressure U2 of the second duct 15. As shown in FIG. 2, the mass m1 of the first duct 14 is connected to the compliance C0 of the cavity 10*a* in series to form a series resonance circuit. Thus, the sound pressure U0 is increased at a resonance frequency of the circuit, thereby reducing the sound pressure U2 so that the sound pressure U2 is radically dipped at the resonance frequency which is higher than the resonance frequency fo and increased in a higher frequency range than the former resonance frequency. Thus, the sound pressure U2 affects the sound pressure U1 which is reduced at the high frequency range.

The sound pressure U2 is not reduced at the high frequency range due to the impedance remained in accordance with the mass m1, and has asymptotic characteristic to a predetermined value determined by a proportion to the masses m1 and m2. Thus, the combined sound pressure U1 becomes a constant value smaller than the sound pressure U0.

Figure 4:
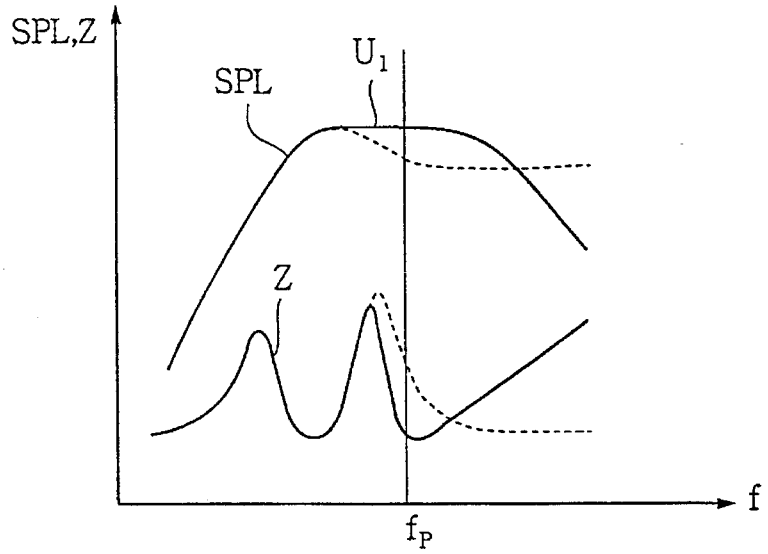
FIG. 4 is a graph showing sound pressure and impedance characteristics of the speaker system with the dividing network.

Referring to FIG. 4, when the dividing network is used, the combined sound pressure U1 is humped so as to approximate a sound pressure at the frequency fo. Thus, the hump of the sound pressure U1 is disappeared. Consequently, the sound pressure U1 has a flat top characteristic.

If the sound pressure is humped at the frequency slightly higher than the frequency where the sound pressure is dipped, the sound pressure is humped continuously with the highest sound pressure at the frequency fo. Thus, the flat top characteristic is further increased.

In the system, the lowest frequency for reproducing the low frequency range is lowered compared with the conventional system. The lowest frequency for reproducing the low frequency range is the frequency fr where the sound pressure U0 is radically dipped.

The frequency fr is determined in accordance with the compliance C0 of the cavity 10*a* and the sum of the masses m1 and m2 of the first and second ducts 14 and 15 (m1+M2) and represented by an equation as follows.

$$fr=\tfrac{1}{2}\pi\sqrt{(1/(m1+m2)C0)}\ (HZ)\ \ldots \qquad (A)$$

Figure 17:
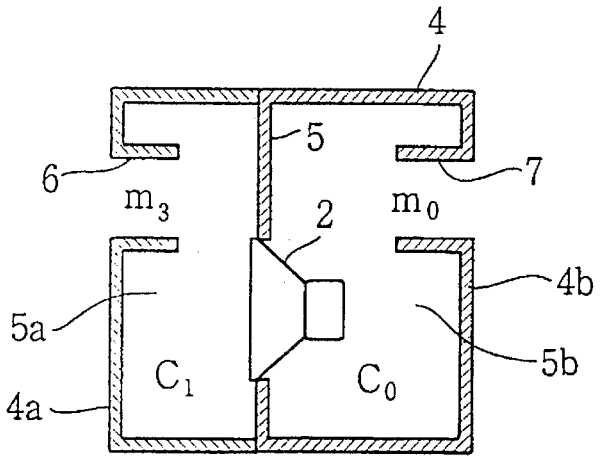
FIG.17 PRIOR ART
FIG. 17 is a sectional side view showing another conventional speaker system.
Figure 18:
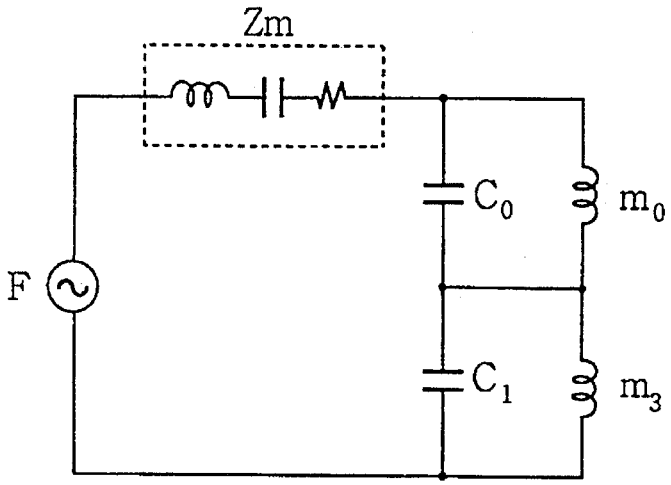
FIG.18 PRIOR ART
FIG. 18 is an equivalent circuit of FIG. 17.
Figure 19:
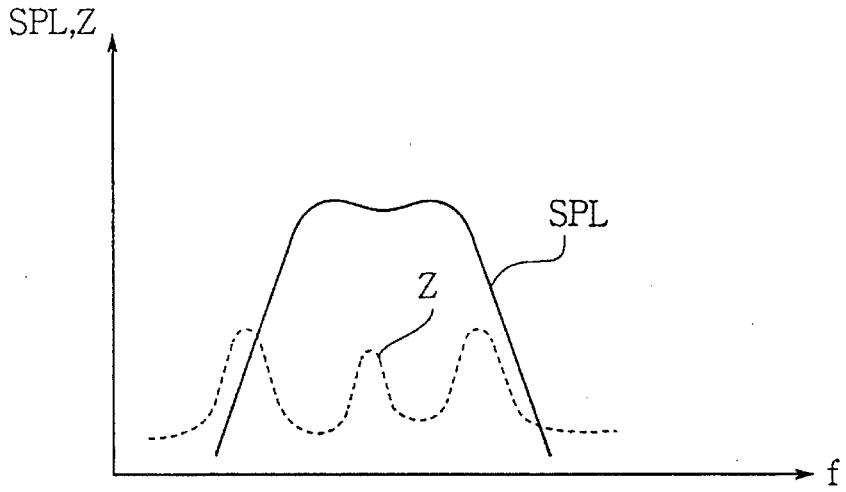
FIG.19 PRIOR ART
FIG. 19 is a graph showing sound pressure and impedance characteristics of the conventional speaker system of FIG. 17.
Figure 20:
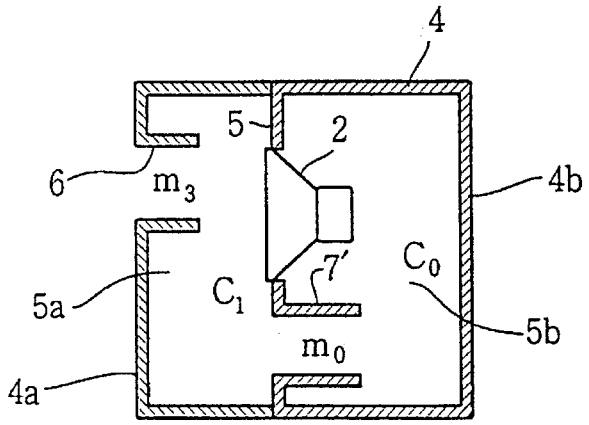
FIG.20 PRIOR ART
FIG. 20 is a sectional side view showing a further conventional speaker system.
Figure 21:
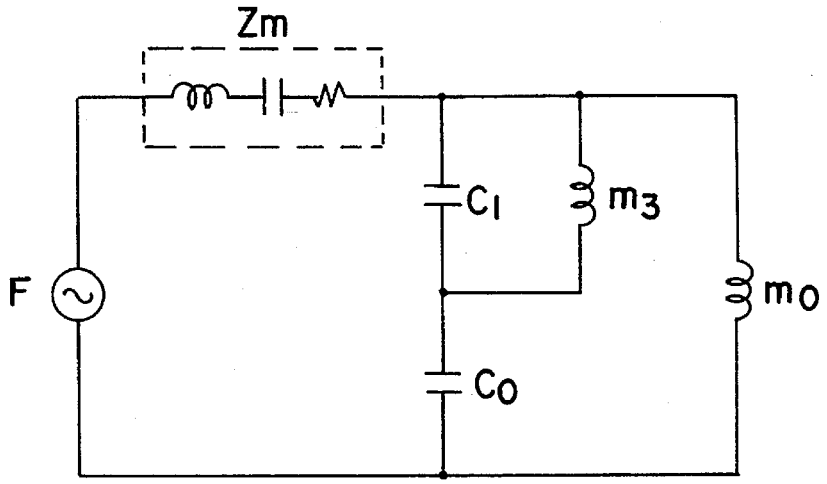
FIG. 21 PRIOR ART
FIG. 21 is an equivalent circuit of FIG. 20.
Figure 22:
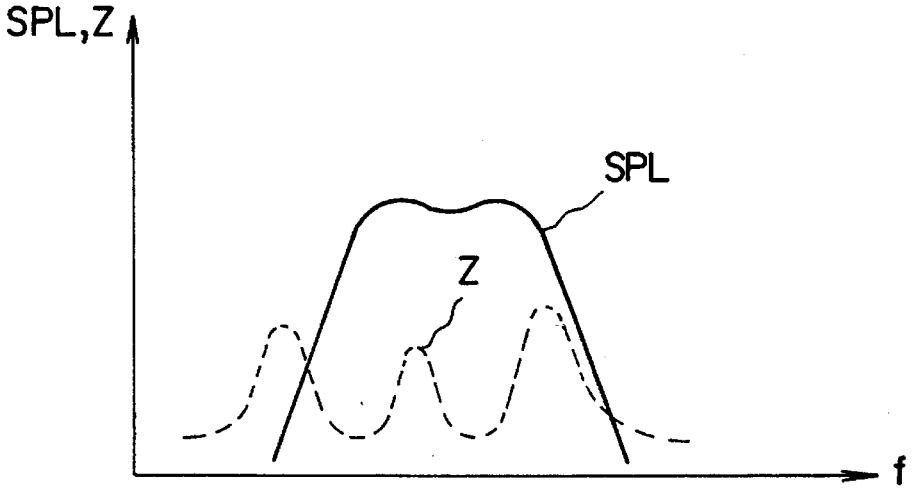
FIG. 22 PRIOR ART
FIG. 22 is a graph showing sound pressure and impedance characteristics of the conventional speaker system of FIG. 20.

In the conventional speaker system shown in FIG. 17 or FIG. 20, the frequency fr is represented as $$fr=\tfrac{1}{2}\pi\sqrt{(1/(m0\cdot C0))}\ (HZ)\ \ldots \qquad (B)$$

From the foregoing, it will be seen that if the volume of the cabinet of the present invention is the same as that of the conventional cabinet, the compliance C0 of the present invention is larger than that of the conventional system. Thus, it is possible to lower the frequency. In other word, the cabinet having a smaller volume can achieve the lowest frequency for reproducing the low frequency range to a predetermined low value.

The relationship between sectional areas of the first and second ducts 14 and 15 affect the sound pressure characteristic.

The sound pressure characteristic can be changed by changing the sectional area of the first duct or the second duct, if the size of the cabinet is limited, as described below. If the first duct 14 has a length L1 and the second duct 15 has a length L2, and both lengths are constant, the sound pressure characteristic is determined as follows.

If the sectional area of the first duct is larger than that of the second duct, a reproducible frequency of a low frequency range is increased as well as a middle frequency range, compared with a case where both the sectional areas are equal to each other. If the sectional area of the first duct is smaller than that of the second duct, the reproducible frequency of the low frequency range is reduced as well as the middle frequency range.

In the embodiment, since the dividing network is used, the sound pressure is humped due to the resonance. The hump is corrected to flat the sound pressure characteristic. Thus, the problem such as masking in the low frequency range is solved, the characteristic of low frequency is improved.

In the cabinet of the speaker system, a plurality of speaker units may be provided on the inner base plate 11.

Figure 5:
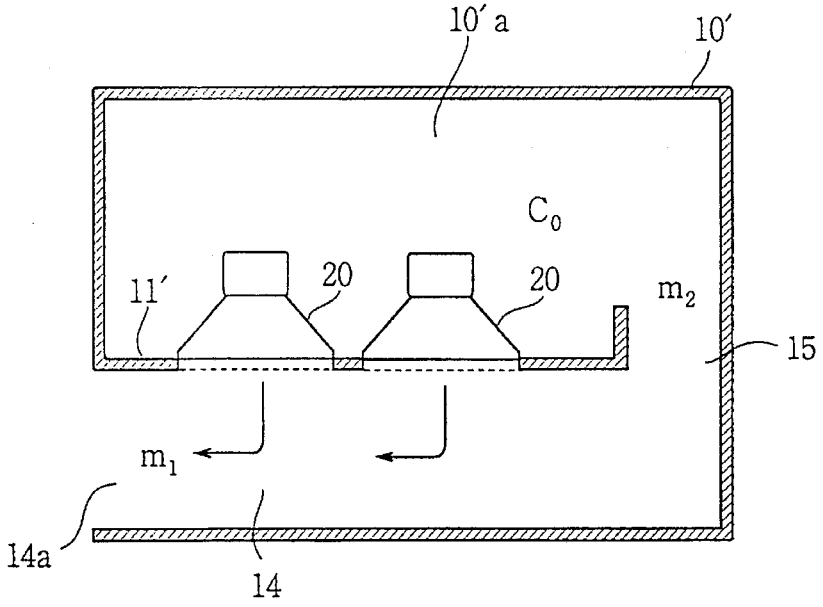
FIG. 5 is a sectional side view showing another embodiment of the present invention.

FIG. 5 shows another embodiment of the speaker system of the present invention. In the system, the second unit 15 is provided perpendicular to the first duct 14. In a bass-reflex cabinet 10', a pair of speaker units 20 are secured to an inner base plate 11' along the axis of the first duct 14. In such a system, the sound source is distributed in the first duct 14, thereby reducing a peak dip of the sound pressure in accordance with resonance of the duct caused by the length of the duct.

Figure 6:
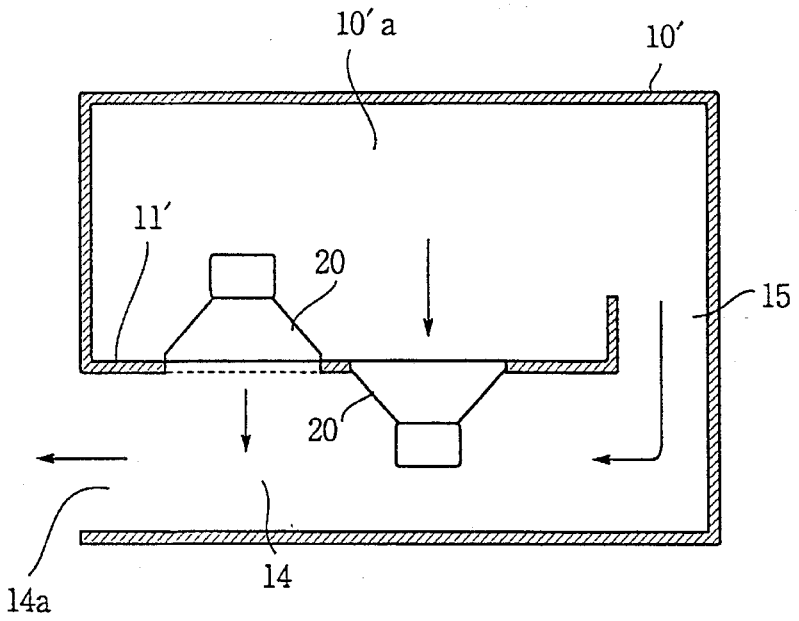
FIG. 6 is a sectional side view showing a modification of the embodiment of FIG. 5.

FIG. 6 shows a modification of the system of FIG. 5 where a pair of speaker units 20 are secured to the inner base plate 11',in the opposite directions. In the system, if a push-pull operation is used to reverse polarities of input signals of speaker units 20, even order harmonic distortion of the speaker unit is canceled so that harmonic distortion of the sound pressure is remarkably reduced.

Figure 7:
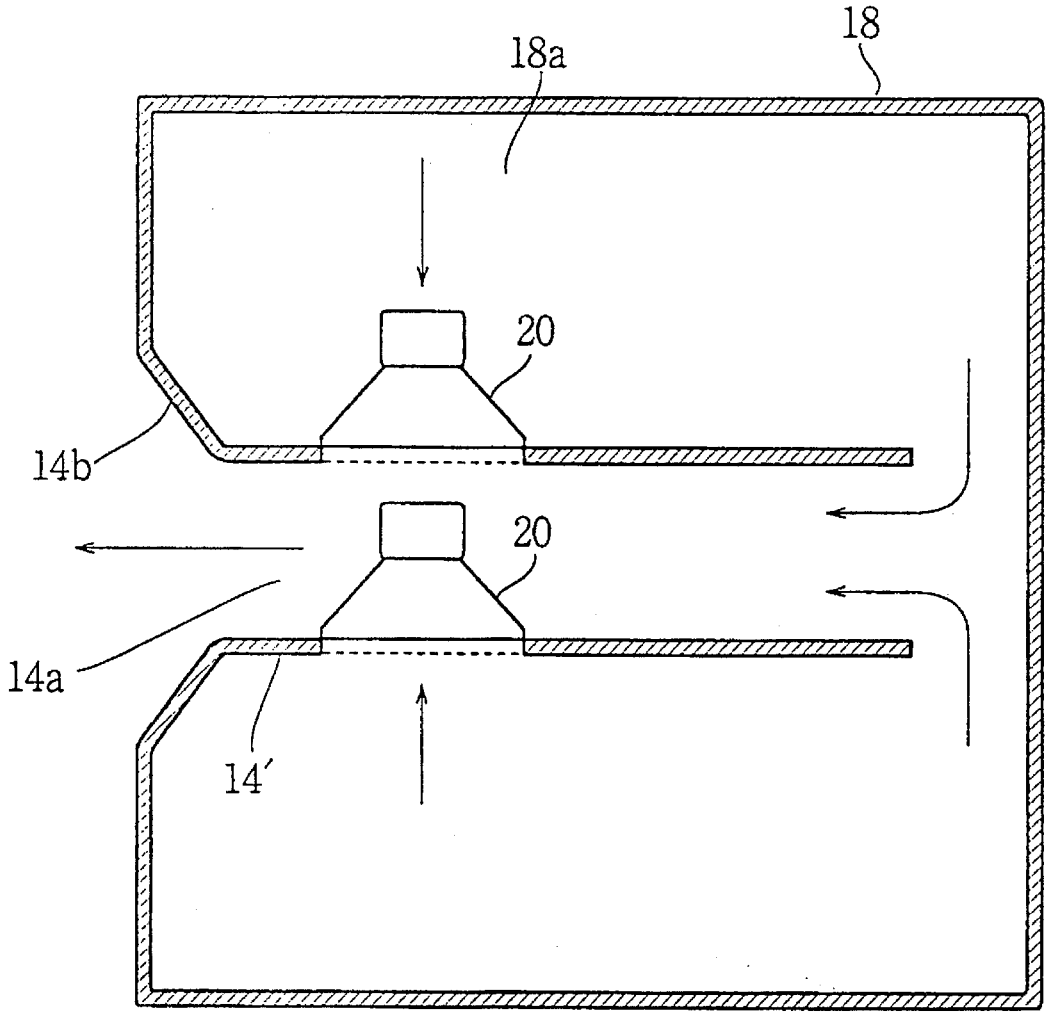
FIG. 7 is a sectional side view showing another modification of FIG. 5.

FIG. 7 shows a further embodiment of the present invention. A horizontal duct 14' is provided in a central portion of a bass-reflex cabinet 18 and pair of speaker units 20 are secured to opposite portions of the duct 14' in the same direction. A tapered portion 14*b* is formed on the port 14*a* of the duct 14'. A cavity 18*a* is formed around the duct 14'.

Abnormal noises caused by a large output power is reduced in the system. By using the push-pull operation, distortion is reduced to obtain a high quality sound.

Furthermore, the shape of the first duct is changeable if the shape is regarded as a duct.

Figure 8:
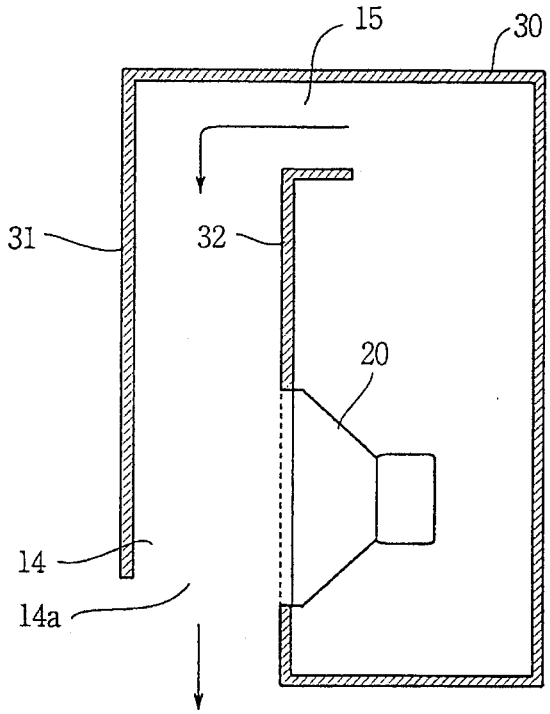
FIG. 8 is a sectional side view showing a further embodiment of the present invention.

Referring to FIG. 8, a bass-reflex cabinet 30 has a vertical inner front plate 32 to which the speaker unit 20 is secured. A front panel 31 of the cabinet 30 has such a length that the lower edge of the panel 31 does not reach the bottom of the cabinet. Thus, a part of the speaker unit 20 is exposed from the front panel 31. The first duct 14 is formed in front of the speaker unit.

Figure 9:
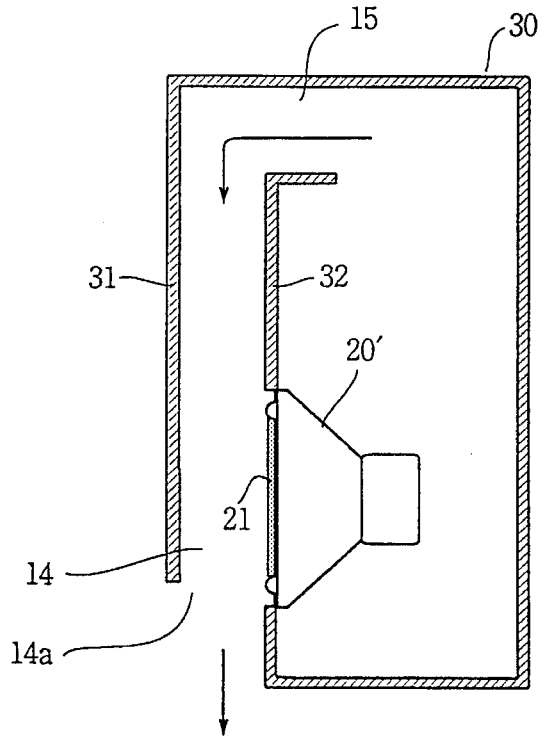
FIG. 9 is a sectional side view showing a modification of the embodiment of FIG. 8.

Referring to FIG. 9, the first duct 14 has a small sectional area compared with that of the duct of FIG. 8. Thus, a speaker unit 20' having a flat diaphragm 21 is secured to the inner base plate 32.

Figure 10:
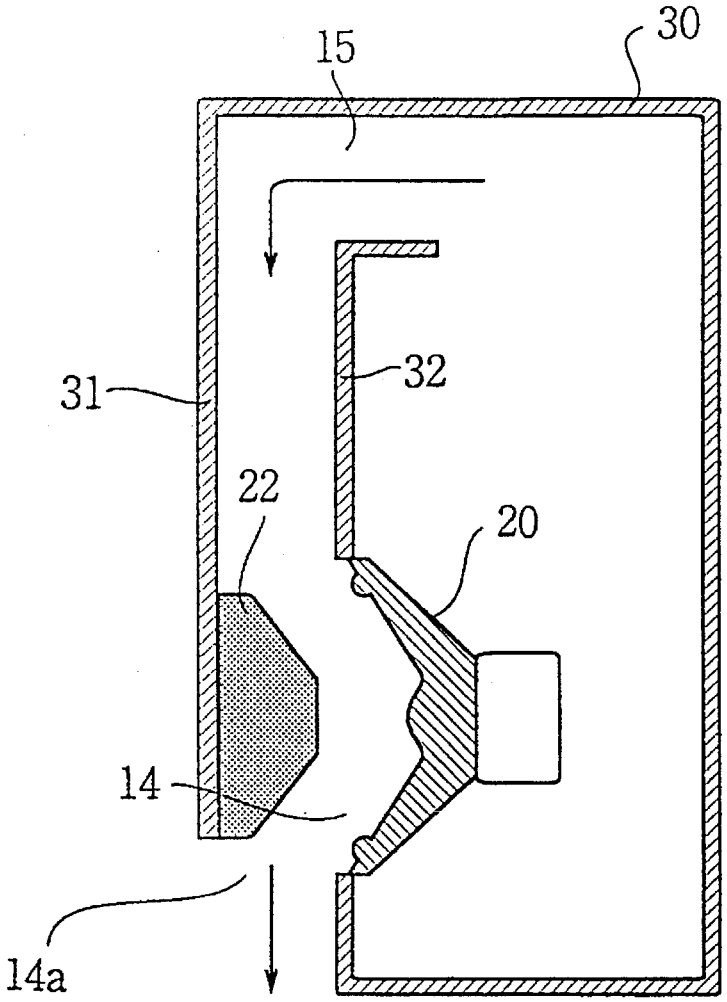
FIG. 10 is a sectional side view showing a modification of FIG. 9.
Figure 11:
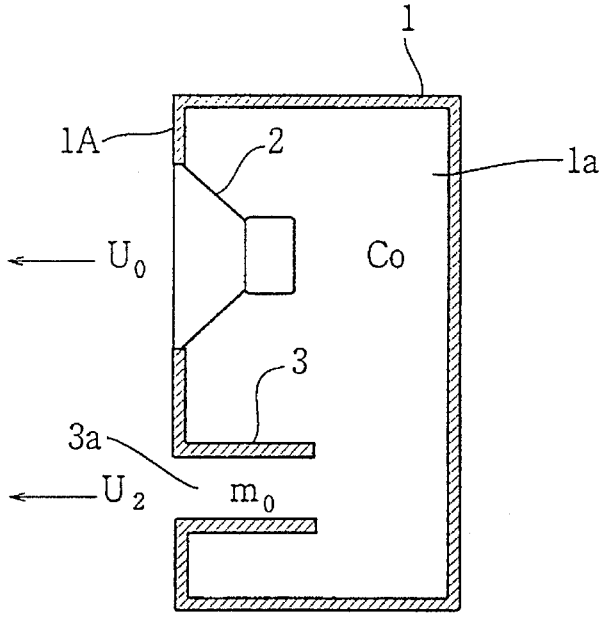
FIG.11 PRIOR ART
FIG. 11 is a sectional side view showing a conventional speaker system.
Figure 12:
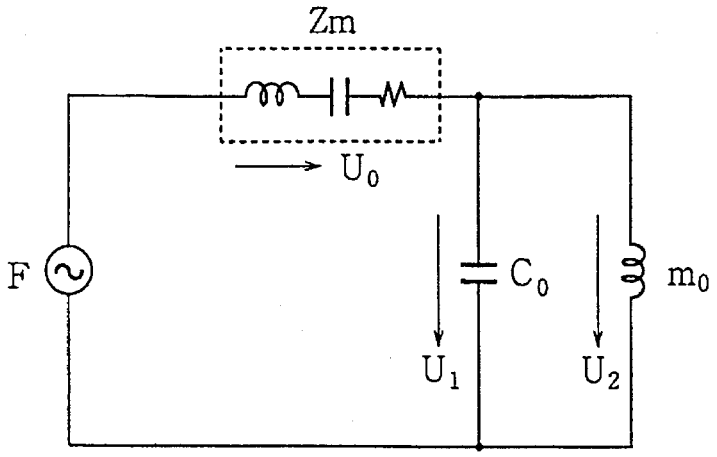
FIG.12 PRIOR ART
FIG. 12 is an equivalent circuit showing a mechanical system of the conventional speaker system.
Figure 13:
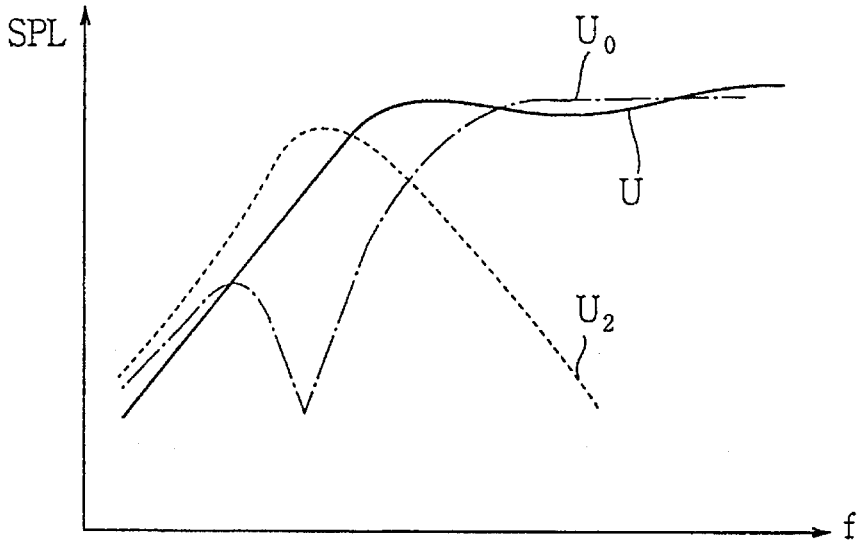
FIG.13 PRIOR ART
FIG. 13 is a graph showing sound pressure characteristics of the conventional speaker system without the dividing network.
Figure 14:
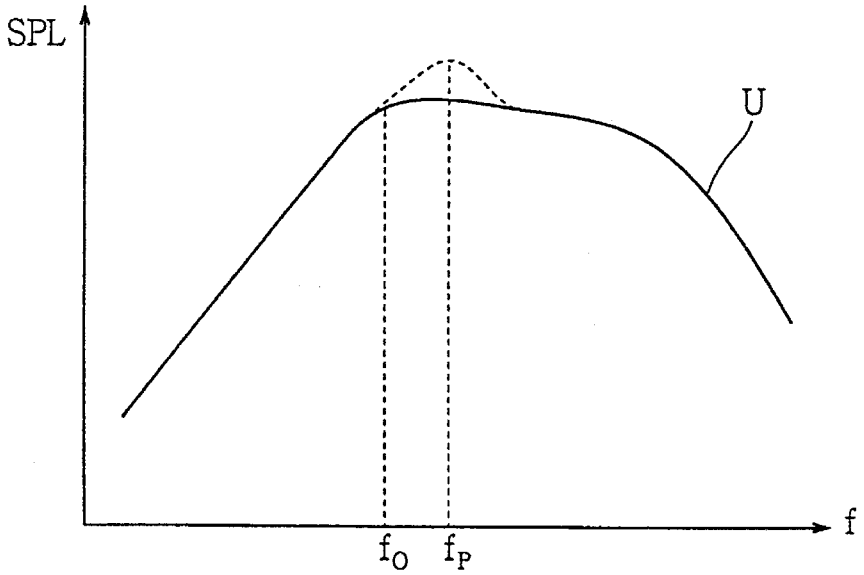
FIG.14 PRIOR ART
FIG. 14 is a graph showing sound pressure characteristic of the conventional speaker system with the dividing network.
Figure 15:
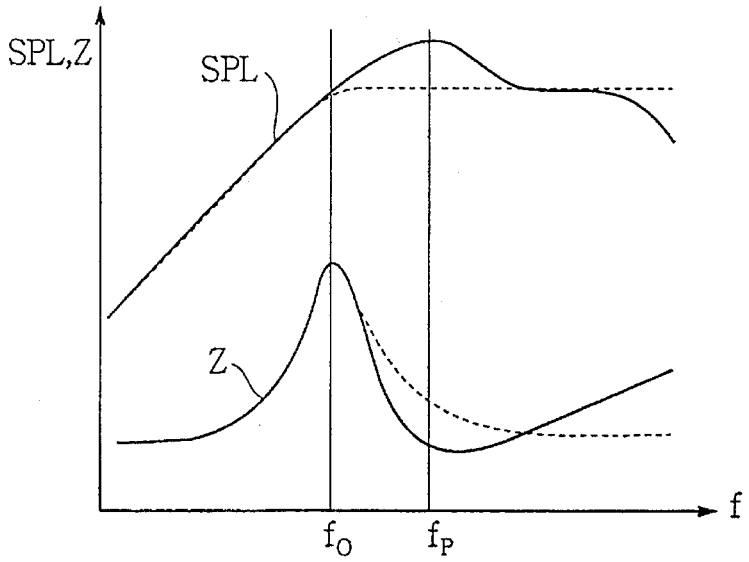
FIG.15 PRIOR ART
FIG. 15 is a graph showing sound pressure and impedance characteristics of the conventional speaker system with the dividing network.
Figure 16:
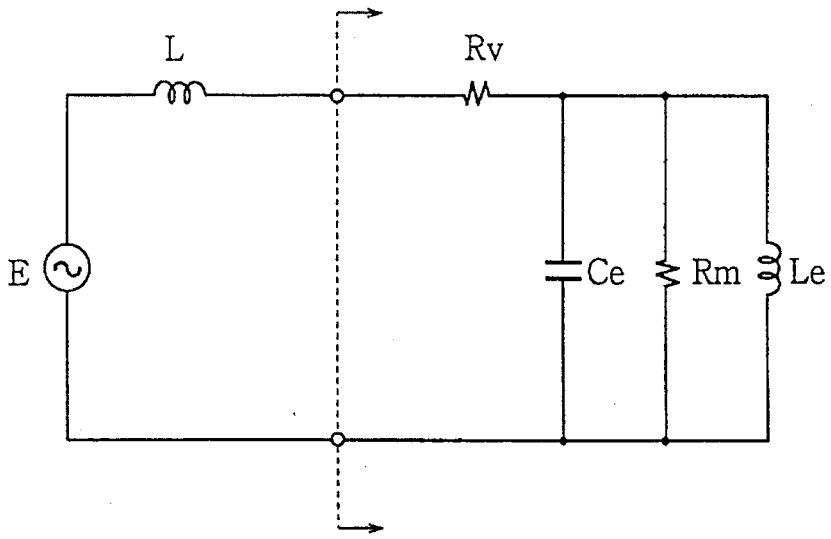
FIG.16 PRIOR ART
FIG. 16 is an equivalent circuit showing an electric system of the conventional speaker system.

FIG. 10 shows a modification of FIG. 9 where an equalizer 22 is secured to an inner portion of the front panel 31 in the first duct 14 corresponding to an indentation of the speaker unit 20. Thus, a constant sectional area of the first duct 14 is obtained.

In the cabinet, if the distance between the front panel 31 and the inner plate 32 is reduced so that the sectional area of the first duct 14 is small, the speaker unit 20 is closed to the front panel. Particularly, in the above-mentioned type of the cabinet, if the sectional area of the duct changes in accordance with the shape of the diaphragm of the speaker unit, the system is not normally operated. Therefore, it is difficult to obtain a flat top characteristic of the sound pressure.

In accordance with the present invention, the bass-reflex cabinet has first and second ducts to combine sound pressures radiated in the forward and rearward directions of the speaker unit in the cabinet.

The lowest resonance frequency is lowered to reduce unnecessary sound pressures in the middle and high frequency ranges. Thus, in the cabinet having a small size, the reproducing band can be extended to a lower frequency range.

When the dividing network is provided, the sound pressure is liable to be humped due to the resonance. In the present invention, the flat top characteristic can be obtained by using the hump of the sound pressure. Thus, reproduced sound of high quality and good feeling of expansion in auditory sensation can be provided.

While the presently preferred embodiments of the present invention has been shown and described, it is to be understood that these disclosures are for the purpose of illustration and that various changes and modifications may be made without departing from the scope of the invention as set forth in the appended claims.

What is claimed is:

1. A speaker system comprising:

a cabinet;

a first speaker unit provided within the cabinet; and a duct for radiating sound pressure emitted from the first speaker unit, wherein a drive signal to be applied to the speaker unit is passed through a network circuit means, said network circuit means for eliminating a high frequency component contained in the drive signal, wherein the duct extends in a direction perpendicular to a radiating direction of the sound pressure radiated from a front side of the first speaker unit, with one end of the duct being communicated with a space of the cabinet, and another end of the duct forming an opening of the speaker system;

wherein the first speaker unit is disposed with the front side thereof positioned at a portion of a wall of the duct;

wherein the duct has a cross section which is perpendicular to a sound propagating direction and has a consistent cross sectional area along an entire length thereof; and wherein sound pressure radiated from a rear side of the first speaker unit is propagated in the duct and applied to the sound pressure from the front side of the first speaker unit, and combined sound pressure is discharged outwardly from the duct.

2. The speaker system according to claim 1 wherein a second speaker unit is provided on the wall of the duct.

3. The speaker system according to claim 2, wherein the first and second speaker units are disposed in opposite directions.

4. The speaker system according to claim 1 wherein the duct is disposed in a central portion of the cabinet.

5. The speaker system according to claim 1 wherein the duct is horizontal.

6. The speaker system according to claim 1 wherein the duct is vertical.

* * * * *